United States Patent [19]

Roth

[11] 4,088,351

[45] May 9, 1978

[54] MACRAME FRAME

[76] Inventor: Jeanne Roth, Rte. 1, Box 53, Eolia, Mo. 63344

[21] Appl. No.: 746,247

[22] Filed: Dec. 1, 1976

[51] Int. Cl.[2] ..... B65H 69/04

[52] U.S. Cl. ..... 289/18; 248/449

[58] Field of Search ..... 289/1.2, 1.5, 18; 28/15; 248/444, 448, 449, 460, 463; 211/203

[56] References Cited

U.S. PATENT DOCUMENTS

| | | | |
|---|---|---|---|
| 486,549 | 11/1892 | Terslose | 248/449 |
| 1,203,781 | 11/1916 | Ratycia | 28/15 |
| 1,691,527 | 11/1928 | Sakurai et al. | 28/15 |
| 2,292,356 | 8/1942 | Belanger | 28/15 |
| 2,395,981 | 3/1946 | Walker | 28/15 |
| 3,715,097 | 2/1973 | Kalajian | 248/449 |

OTHER PUBLICATIONS

Macrame by D. Z. Meilach, Crown Publishers, Inc. N.Y., copyright 1971, p. 175.

Macrame by the Editors of Sunset Books, Lane Publishing Co., Menlo Park, Ca., p. 7, copyright 1971.

*Primary Examiner*—Louis K. Rimrodt

*Attorney, Agent, or Firm*—Cohn, Powell & Hind

[57] ABSTRACT

This macrame frame includes a pair of elongate side members pivotally interconnected at the upper ends and having a hook assembly at the connection point adapted to hold looped macrame cord. The side members are pivotally interconnected at the lower end to an elongate member having an intermediate clamp assembly adapted to clamp the macrame cord. The side members and lower member are slotted to provide for adjustment of the pivot connections to selectively determine the distance between the hook assembly and the clamp assembly and also to determine the size of the open work area between the members.

3 Claims, 6 Drawing Figures

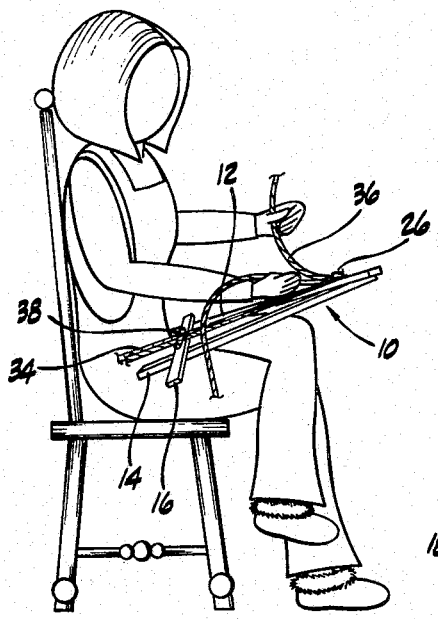
FIG. 5.
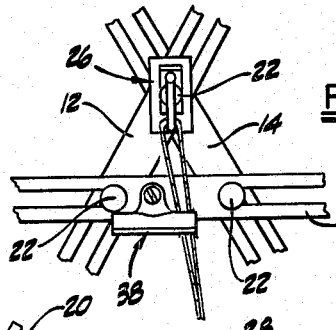
FIG. 1A.
FIG. 3.
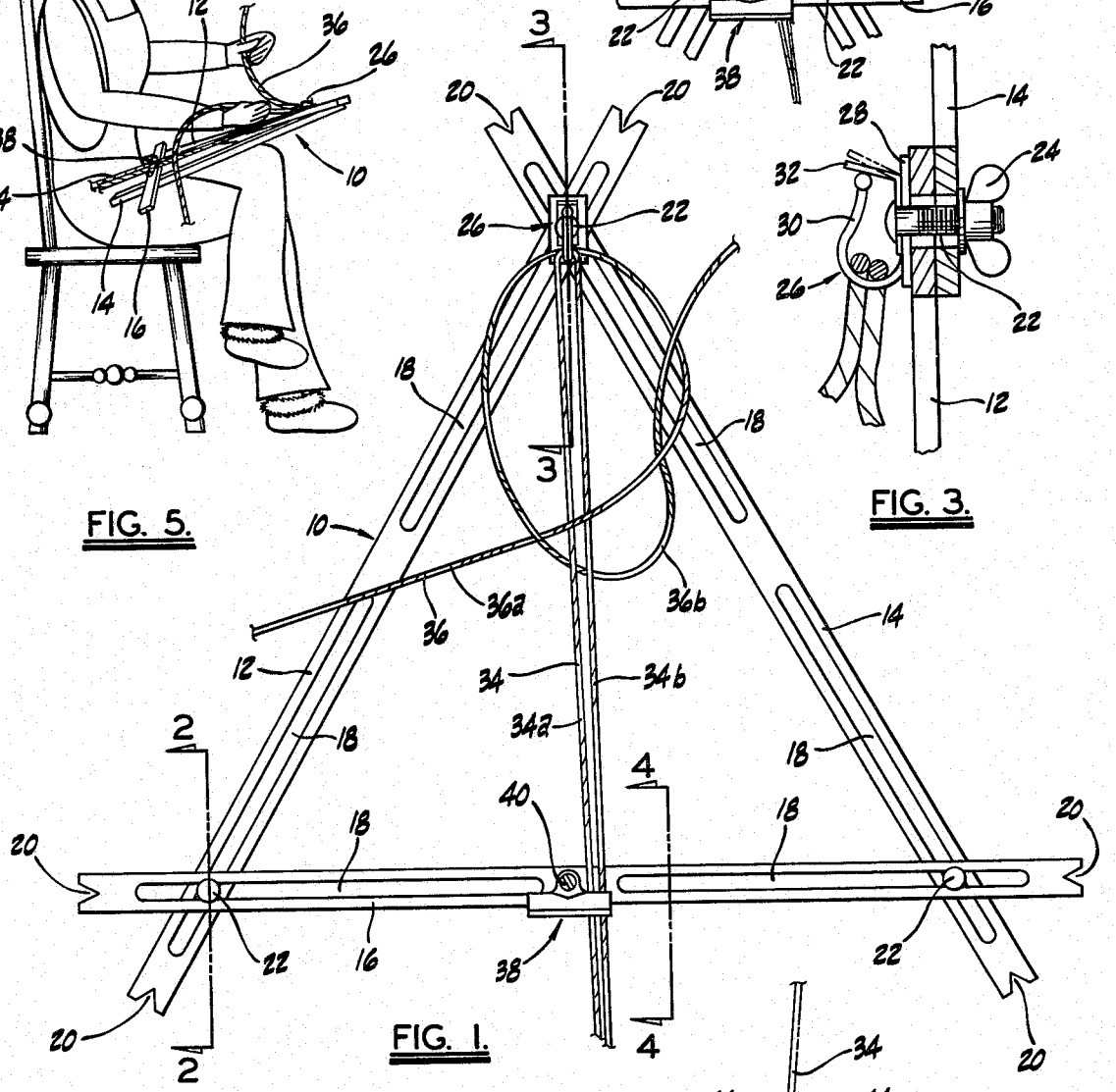
FIG. 1.
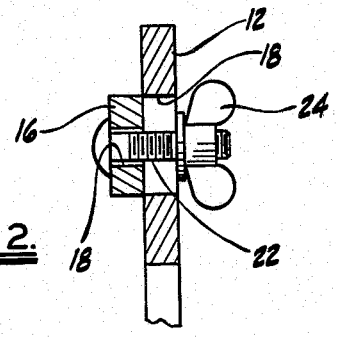
FIG. 2.
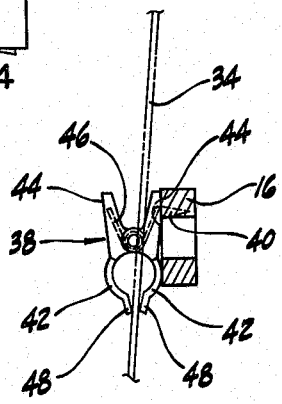
FIG. 4.

MACRAME FRAME

BACKGROUND OF THE INVENTION

This invention relates to the art of macrame and particularly to a frame for holding and clamping the macrame cords.

Although the art of macrame, which is defined as the knotting of cords into geometrical patterns, has been known for many years, the standard procedure heretofore has been to practice the knotting of the cords by hand without the assistance of any frame to facilitate the process. The closest known prior art is provided by stands which are used to facilitate braiding. One such stand provides collapsible members to facilitate storage thereof and another provides a tripod structure which improves the stability of the stand. Neither of these known devices is particularly helpful in the macrame process.

Frames are known which are used to facilitate simple weaving processes. Such frames and hand looms are generally rectangular in configuration and in some instances are adjustable in size to vary the width of the woven workpiece.

However, none of the known frames of this type provides any disclosure or suggestion of a means of releasably clamping the material being woven.

SUMMARY OF THE INVENTION

This macrame frame provides a means of holding and clamping macrame cords to facilitate the knotted interconnecting of such cords into macrame geometric formations.

This macrame frame includes a pair of side members interconnected at their upper end and including holding means at said upper end for receiving a looped macrame cord, said frame having a lower connection means connecting the lower ends of said frame members together, said lower connection means including clamping means for releasably clamping said cords in spaced relation from said holding means.

The lower connection means includes a lower elongate member attached in extending relation between said side frame members, said side frame members and lower frame member defining a substantially triangular open work space.

The upper end connection between the side frame members and the lower end connections between the side frame members and the lower frame member are provided by pivot fasteners, and the side frame members and the lower frame member are provided with longitudinally extending slotted portions receiving the pivot connections to permit relative movement of the frame members incident to adjusting the size of the frame.

The holding means includes a hook element integrally formed with the upper pivot connection and the clamping means includes a clamp element fixedly attached to the lower member intermediate the ends thereof.

The method of forming the macrame cords into geometrical forms comprises the steps of looping a first macrame cord into a double strand, holding the first cord at the looped end and releasably clamping the double strands of the first cord in spaced relation to the held end; looping a second macrame cord into double strands and knotting the double strands of the second cord into interconnected relation with the strands of the first cord between the held end and the clamped end of said first cord.

BRIEF DESCRIPTION OF THE DRAWING

FIG. 1 is a front elevational view of the frame illustrating the method of use;

FIG. 1A is a fragmentary view of the frame adjusted to accommodate finer macrame cords;

FIG. 2 is an enlarged sectional view taken on line 2—2 of FIG. 1 illustrating a lower pivot connection;

FIG. 3 is an enlarged sectional view taken on line 3—3 of FIG. 1 illustrating the upper pivot connection;

FIG. 4 is an enlarged sectional view taken on line 4—4 of FIG. 1 illustrating the clamp; and FIG. 5 is a perspective view illustrating the frame in use.

DESCRIPTION OF THE PREFERRED EMBODIMENT:

Referring now by reference numerals to the drawing and first to FIG. 1, it will be understood that the macrame frame is generally indicated by numeral 10 and, in the preferred embodiment, is substantially triangular in configuration. The frame 10 is formed from oppositely inclined side members 12 and 14 and a lower member 16. The members 12, 14 and 16 are, in the preferred embodiment, substantially identical and each includes slotted portions 18 at each end as well as notched portions 20.

As clearly shown in FIG. 3, the side members 12 and 14 are connected together by connection means which include a fastener 22 extending through the overlapping slots 18 of these members, said fastener being provided with a releasable wing nut 24. A hook assembly 26, constituting a holding means, is provided at the intersection point and said assembly includes an apertured base element 28, an integrally formed hook element 30 and an apertured spring element 32. The hook assembly 26 is connected to the frame 10 by means of the fastener 22 and is adapted to receive looped macrame cords 34 and 36 having double strands **34*a*, 34*b* and 36*a*, 36*b*** respectively.

The lower pivot connections are clearly shown in FIG. 2 and these connections each include a fastener 22 provided with a wing nut 24, said fastener extending through overlapping slots 18 in the lower member 16 and the side members 12 and 14, said fasteners and lower member constituting a connection means between said side members. A clamp 38 constituting a clamping means is attached to the lower member 16 as by a screw 40. This clamp includes pin connected clamping halves 42 having integrally formed finger grip portions 44 of reduced width and clamping lips 46 urged together by a coil spring 48 to permit the macrame cord strands **34*a* and 34*b* to be received therebetween in clamped relation as clearly shown in FIG. 4**.

It will be understood that the slotted nature of the elongate members 12, 14 and 16 and the provision of releasable pivot connection fasteners 22 at the intersection points of said members permits the distance between the hook assembly 26 and the clamp to be adjusted as desired very easily. This adjustable feature, which is illustrated by FIG. 1A, provides a considerable working range for the frame 10 and permits the use of lightweight as well as heavyweight macrame cords. Because of this the frame can be used to produce large macrame items, such as heavy plant hangers several feet

MACRAME FRAME

BACKGROUND OF THE INVENTION

This invention relates to the art of macrame and parfirst cord between the held end and the clamped end of said first cord.

BRIEF DESCRIPTION OF THE DRAWING

FIG. 1 is a front elevational view of the frame, still